US006196144B1

(12) United States Patent
Kiss

(10) Patent No.: US 6,196,144 B1
(45) Date of Patent: Mar. 6, 2001

(54) DEVICE FOR CARRYING OUT HIGH-TEMPERATURE RECYCLING OF HETEROGENOUSLY OCCURRING WASTE AND PROCESS FOR CHARGING THEREOF

(75) Inventor: Günter H. Kiss, Minusio (CH)

(73) Assignee: Thermoselect AG (DE)

( * ) Notice: Subject to any disclaimer, the term of this patent is extended or adjusted under 35 U.S.C. 154(b) by 0 days.

(21) Appl. No.: 09/345,941

(22) Filed: Jul. 1, 1999

(51) Int. Cl.[7] ..... F23B 1/38; F23G 5/02; F23G 5/04

(52) U.S. Cl. ..... 110/342; 110/196; 110/219; 110/223; 110/224; 110/227; 110/101 R; 110/102; 110/327; 110/255; 110/289

(58) Field of Search ..... 110/196, 218, 110/219, 223, 224, 227, 228, 101 R, 102, 342, 327, 235, 255, 256, 289, 267, 292; 432/184, 215

(56) References Cited

U.S. PATENT DOCUMENTS

| | | | | |
|---|---|---|---|---|
| 916,394 | * | 3/1909 | Dwight | 266/178 |
| 3,697,056 | * | 10/1972 | Prins, Sr. et al. | 263/8 R |
| 3,855,950 | * | 12/1974 | Hughes, Jr. et al. | 110/8 C |
| 4,473,014 | * | 9/1984 | Dejanovich | 110/264 |
| 4,637,327 | * | 1/1987 | Jorgensen | 110/289 |
| 4,650,546 | * | 3/1987 | Le Jeune | 201/6 |
| 4,732,090 | * | 3/1988 | Bollmann, Sr. et al. | 110/196 |
| 5,197,684 | * | 3/1993 | Bihlet et al. | 241/283 |
| 5,890,443 | * | 4/1999 | Taya et al. | 110/346 |
| 6,030,204 | * | 2/2000 | Breen et al. | 431/4 |

* cited by examiner

*Primary Examiner*—Denise L. Ferensic
*Assistant Examiner*—Ken B. Rinehart
(74) *Attorney, Agent, or Firm*—Howard & Howard

(57) ABSTRACT

The invention relates to a device, and a process for its charging, for carrying out high-temperature recycling for heterogeneously occurring waste in compact packages. The compact packages are introduced into a heated channel for evaporation of liquids and slightly fluid materials as well as to partly decompose them. The invention is characterized by a temperature insulating mouthpiece interconnecting the reactor and the channel for limiting the conduction of heat from the reactor to the channel. Accordingly, packages may be serially forced through the channel and into the reactor while maintaining the packages in sealing engagement with the channel to prevent reduction in the predetermined cross section in response to high temperatures transmitted from the reactor.

4 Claims, 1 Drawing Sheet

DEVICE FOR CARRYING OUT HIGH-TEMPERATURE RECYCLING OF HETEROGENOUSLY OCCURRING WASTE AND PROCESS FOR CHARGING THEREOF

BACKGROUND OF THE INVENTION (1) Field of the Invention

The invention relates to a device, and a process for charging thereof, for carrying out high-temperature recycling for heterogeneously occurring waste.

(2) Description of the Prior Art

It is thus known from German Patentschrift 4 130 416, to thermally treat heterogeneously occurring waste in unsorted, untreated form so that all contents are thermally separated and optionally subjected to material conversion, so that high-temperature recycling may be achieved with complete processing. The heterogeneously occurring waste is thus compressed to form compact packages and charged into an elongated channel heated externally, wherein the temperature of the heated channel should be above 100~C. Non-positive contact with the channel walls should thus be maintained only until the entrained liquids and slightly fluid materials are evaporated and existing recovery forces of individual components are compensated.

It has now been shown that there are material conversions due to the heat input into the compact packages via the externally heated channel, which firstly may reduce the volume, and that secondly the recovery forces of the compacted waste are compensated considerably more quickly than is desirable from the point of view of gas tightness.

A similar solution is also described in German Patentschrift 4 339 548 and there in the corresponding process the gases and condensation products being produced are removed in the direction of the high-temperature reactor via additional side channels arranged outside of the channel. Removal takes place via appropriately designed openings and additional rotating mechanical clearing devices are present at the side channels.

SUMMARY OF THE INVENTION

It is the object of the invention to improve the gas tightness at the inlet to a channel, such as that shown in German Patentschrift 4 130 416.

The device of the invention is thus designed so that the heterogeneously occurring waste in unsorted form is compressed without any further pre-treatment to form compact packages having a predetermined cross section which are serially forced through a heated channel of equal cross section for evaporation of liquids and slightly fluid materials. A high-temperature reactor is connected to this channel for thermal treatment and processing of the different material components present in the waste. The [device of the] invention is characterised by a temperature insulating mouthpiece interconnecting the reactor and the channel for limiting the conduction of heat from the reactor to the channel.

Accordingly, packages may be serially forced through the channel and into the reactor while maintaining the packages in sealing engagement with the channel to prevent reduction in the predetermined cross section in response to high temperatures transmitted from the reactor. [in that a non-heated section is present at the inlet of the channel into which at least one compact package of the compressed waste may be introduced.]

BRIEF DESCRIPTION OF THE DRAWING

A single FIGURE shows schematically the construction of a device of the invention.

DETAILED DESCRIPTION OF THE INVENTION

Figure 1:
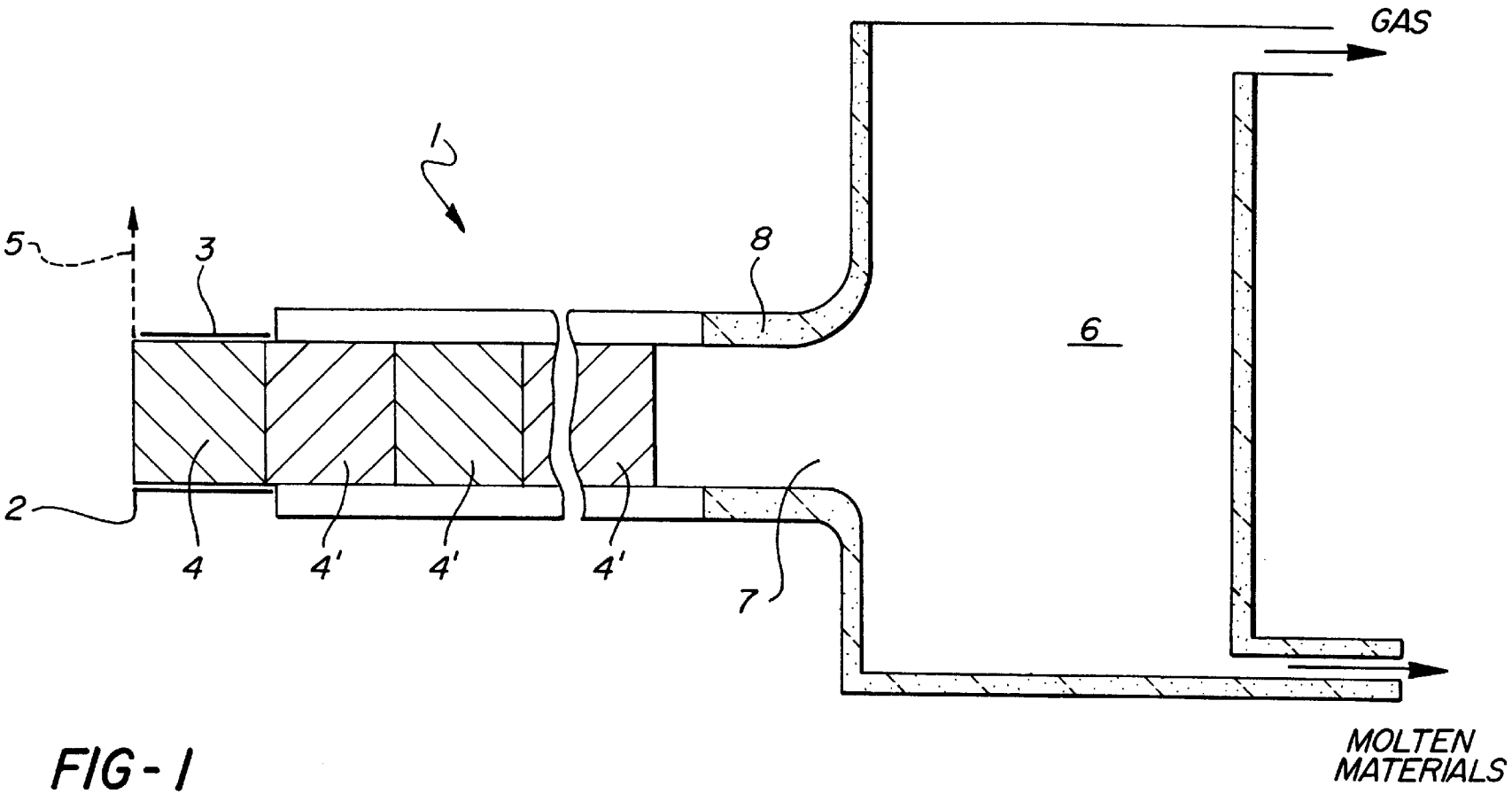

The FIGURE shows how a compacted, compressed compact package 4 is introduced through the channel inlet 2 of the channel 1, and for charging as clearly emphasized by the dashed representation using an arrow, through the opened closure 5 in a first non-heated section 3 of the channel 1.

To illustrate the principle, further compact packages 4' are shown which are conveyed in channel 1 under the action of the pressing force of the compact package 4. The heated section of the channel 1 is thus only partly shown over its entire length.

Initial material conversions thus take place in the section following the first non-heated section 3 of the channel 1, for example by means of evaporation and degassing processes. The vapours and condensates formed may only escape from the channel 1 in the direction of the high-temperature reactor 6, and are thermally converted there or converted in subsequent process steps, which follow the high-temperature treatment in the high-temperature reactor 6, and passed to further processing. Discharge of these condensates or gases is prevented with certainty by the compact package 4 situated in the first non-heated section 3 of the channel 1, since the latter is so compressed that it is impermeable to gases or condensates and also remains so until the compact package 4 is conveyed by a further compact package introduced into the channel inlet 2 from the non-heated section 3 of the channel 1 in the direction of the high-temperature reactor 6.

The compact package 4 is thus compacted and the waste compressed together before introduction through the channel inlet 2 using a press not shown, so that the external dimensions of the compact package 4 almost match the cross-section of the channel 1 and the recovery forces of the compacted waste in the first non-heated section 3 of the channel 1 act against the inner wall of the channel 1.

A mouthpiece 7, in which the channel 1 emerges and through which the thermally pre-treated compact packages 4, the gases and condensates formed pass to the high-temperature reactor 6, is formed on the high-temperature reactor 6.

The mouthpiece 7 is preferably provided with insulation 8 made from refractory material, which corresponds to that in this region of the high-temperature reactor 6 to restrict the influence of the high temperatures in the high-temperature reactor 6.

The discharge of gases formed during the high-temperature treatment, which of course is also the discharge for the molten materials which are passed to further processing, is shown schematically for the high-temperature reactor The device of the invention is favourably designed so that temperatures are maintained below 100° C. in this non-heated section.

The channel may thus be insulated in this section and/or equipped with cooling on the channel wall. It is thus favourable for the compact packages to have dimensions and be compacted so that gas tightness is guaranteed at least for the opening time of the actual channel closure when a new compact package is introduced, and this may otherwise be achieved in cooperation with the closure at the channel entrance. Of course more than only one compact package may thus also be accepted in the non-heated section of the channel. However, compact package and non-heated section may also have dimensions such that just a part of a compact package is enough to close and seal the channel on the inlet side.

Only minor processes take place in these temperature ranges which lead to a change in the compact packages and the material components present therein. Hence there is no reduction in volume, since the temperatures in the non-heated section of the channel do not effect a reduction in the recovery forces of the waste compressed to give compact packages and the recovery forces even press the compact packages against the inner wall of the channel. The waste therefore is and remains adequately compacted in the compact packages to prevent gases formed in the further path of the process from being able to emerge in the direction out of the channel inlet, so that the discharge of poisonous or dangerous gaseous materials may be avoided there and the entire material content of the waste may be subjected to high-temperature recycling.

The invention may be further developed by forming a mouthpiece on the high-temperature reactor which is thermally insulated, preferably using a refractory lining, and/or is equipped with cooling, into which the channel emerges. The dimensions of this mouthpiece, together with the insulation or cooling, should ensure that a temperature gradient of at least 500°C. may be reached between high-temperature reactor and the end of the channel or mouthpiece, to protect the actual channel from the very high thermal stress. In a preferred embodiment provision is made in that at least one sample introduction connection is provided in the mouthpiece 7.

Suspensions, slurry or gas mixtures may be supplied to the reactor directly using sample introduction connections of this type after adequate pre-compacting for iow-pollutant processing of intermediate products obtained or for material conversion of products which cannot be used externally from, for example filter dusts, contaminated absorbent materials, (for example active charcoal) or powder mixtures. Two to four sample introduction connections are preferably arranged in the mouthpiece.

The outlet of the channel or the mouthpiece in the high-temperature reactor, through which the compact packages which have already been pre-treated thermally are pushed into the high-temperature reactor, should favourably be arranged at the most up to the center of the reactor height or below the central line of the high-temperature reactor. This has the advantage that the channel outlet is arranged in a region of the high-temperature reactor in which the maximum temperatures do not occur.

What is claimed is:

1. A method of recycling compacted packages of heterogeneous waste comprising the steps of:

providing compacted packages of heterogeneous waste having a predetermined cross section, forcing the packages serially into a channel having a constant interior cross-section substantially the same as the predetermined cross section of the packages to effectively seal the channel, forcing the packages along the channel and into a high-temperature reactor while maintaining the packages in sealing engagement with the channel to limit backflow of gases from the reactor and through the channel, limiting heat conduction between the reactor and the channel to prevent reduction of the predetermined cross section of the packages in the channel in response to high-temperatures transmitted from the reactor.

2. A method as set forth in claim 1 including moving the packages over a refractory material before entry into the reactor.

3. A method as set forth in claim 1 including maintaining a temperature differential between the channel and the reactor of at least 500° C.

4. A method as set forth in claim 1 including cooling the environment of the packages prior to introduction into the reactor.

* * * * *